US005616642A

United States Patent [19]

West et al.

[11] Patent Number: 5,616,642

[45] Date of Patent: Apr. 1, 1997

[54] LEAD-FREE FRANGIBLE AMMUNITION

[76] Inventors: Harley L. West, P.O. Box 850678, Yukon, Okla. 73085; John F. Mullins, P.O. Box 625, Burns Flat, Okla. 73624

[21] Appl. No.: 423,660

[22] Filed: Apr. 14, 1995

[51] Int. Cl.[6] ..... G08K 3/00

[52] U.S. Cl. ..... 524/439; 524/440; 524/445; 102/506; 102/529

[58] Field of Search ..... 524/406, 408, 524/413, 435, 442, 445, 447, 448, 539, 540, 439, 440; 102/501, 529, 506

[56] References Cited

U.S. PATENT DOCUMENTS

| | | | |
|---|---|---|---|
| 2,995,090 | 8/1961 | Daubenspeck | 102/91 |
| 3,123,003 | 3/1964 | Lange, Jr. et al. | 102/91 |
| 3,785,293 | 1/1974 | Barr et al. | 102/92.7 |
| 4,466,330 | 8/1984 | Juretzek et al. | 86/20 R |
| 4,603,637 | 8/1986 | Snide et al. | 102/529 |
| 5,189,077 | 2/1993 | Kerby | 523/116 |
| 5,237,930 | 8/1993 | Belanger et al. | 102/529 |
| 5,359,936 | 11/1994 | Simpson et al. | 102/385 |

FOREIGN PATENT DOCUMENTS

| | | |
|---|---|---|
| 0096617 | 6/1982 | France . |
| 2092274 | 1/1981 | United Kingdom . |
| 8809476 | 5/1988 | United Kingdom . |

*Primary Examiner*—Edward J. Cain
*Attorney, Agent, or Firm*—Oldham & Oldham Co., LPA

[57] ABSTRACT

The invention relates to lead-free frangible ammunition wherein the bullets are made of from 85% to 93% by weight of powders of copper, tungsten, ceramic, bismuth, stainless steel or bronze, or blends/alloys of the identified materials, the powder present in a polyester matrix with a small amount of ionomer. The bullets are injection molded under pressure to produce a projectile of appropriate size and weight and comparable to similarly sized live ammunition. The consistency of the bullet is such that it is frangible and will break upon impact with any hard surface, such as sheet steel. Polyester is a preferred polymeric matrix material in that it is a far more dense polymer than previously used nylons. The specific gravity of polyesters is ~1.30, as compared with ~1.02 for nylons. This enables the fabrication of a bullet with a greatly increased weight, for while the copper/polymer ratio remains at approximately the 90/10 range, the increased density allows for more actual copper by weight.

14 Claims, No Drawings

LEAD-FREE FRANGIBLE AMMUNITION

TECHNICAL FIELD

The invention described herein pertains generally to lead-free, frangible practice ammunition or bullets for use as an alternative to live ammunition rounds at indoor or outdoor firing ranges. More specifically, the present invention relates to low cost practice ammunition having a bullet composed of a high percentage of metal powder dispersed within a polyester matrix. The bullet made in accordance with the present invention can be loaded in ammunition having an ordinary brass casing using commercially available lead-free primers.

BACKGROUND OF THE INVENTION

Lead pollution at firing ranges has been a problem for a number of years. Because of current interest in the reduction of lead pollution, correction of this problem has become more important in recent years. There are several sources of lead at these firing ranges. Ordinary primers which are used in conventional ammunition to activate the ammunition's explosive charge or propellant, contain lead styphnate which is propelled into the air as a particulate. The lead bullet or projectile itself also contributes significantly to lead pollution from several mechanisms inherent in the firing process. The heat created from the explosion of the ammunition's propellant upon firing, melts minute quantities of the lead in the bullet or projectile which is propelled out of the barrel of the gun and solidifies into microscopic particulates. The friction between the lead bullet or projectile and the gun barrel creates additional lead particulate through abrasion. When the bullet or projectile strikes the back stop or other restraining mechanism at the firing range, the bullet or projectile is broken or otherwise disintegrates from the impact, resulting in additional lead particulate accumulation.

The United States government, particularly the agencies involved in monitoring safety conditions, has set extremely restrictive standards governing the amount of airborne lead particulate which can be generated at firing ranges. As a result of the imposition of these standards, many ranges have been forced to install expensive ventilation and filtration systems, or to cease operations entirely. Restrictive standards have also been implemented governing the presence of lead in earthen butts typically associated with outdoor firing ranges. Through exposure to rain, lead can leach into underground water tables, thereby causing drinking water problems. As a result, outdoor ranges are being forced to excavate this lead and dispose it as well as all of the lead-contaminated earth disposed of in accordance with regulations dealing with the safe handling, transportation and disposal of hazardous materials.

Prior attempts have been made to solve this problem through the use of non-lead alternative metals, e.g., copper, bismuth etc., and loading the ammunition with lead-free primers. This solution however creates its own problems. Typically, the solid copper rounds cause more damage to the back stop of the range, and also have a greater tendency to ricochet and splash back, with attendant safety hazards. In the case of bismuth, the high costs of the material makes it a viable alterative only when the substantially higher cost of the round is no object.

There have been a number of other efforts in the prior art to alleviate the problem of lead pollution at firing ranges. One such attempt is disclosed in U.S. Pat. No. 2,995,090 to Daubenspeck who teaches the manufacture of a gallery bullet using a thermoplastic binder to adhere iron powder into a solid bullet body. Daubenspeck's bullet was made by dissolving the plastic binder in a solvent and mixing the plastic solvent solution with metal powder to coat the individual particles of the powder. The coated particles are then cold-molded into a bullet and baked at a temperature of about 100° F. above the softening point of the plastic binder to complete the internal bonding of the cold-molded bullet. The Daubenspeck technique does not provide adequate structural strength to the resulting product to provide consistent firing results. Bullets made according to this process lack sufficient weight and/or specific gravity to enable the bullets to mirror a live ammunition round of similar size and caliber.

In U.S. Pat. No. 3,570,406 issued to Steyerberg et al., another alternative is taught wherein the loose bulk granular filing is coated with a synthetic jacket. The jacket either disintegrates upon firing or upon impact. The Steyerberg bullet however, does not provide the strength and accuracy of the bullet of applicant's invention. Other proposed solutions have involved the use of various thermoplastics in conjunction with various types of metal fillers. European Patent Disclosure EP-A-0 096 617 to Societe Francaise de Munitions (SFM) describes a training bullet having a mixture of nylon, a powder of a ductile material and a solid lubricant. This disclosure describes a practice ammunition wherein the specific gravity of the compound is between 3 and 5.

World Intellectual Property Organization Publication 88-09476 describes a bullet comprised of a matrix of plastics having a water absorption factor similar to or greater than that of nylon-11 and containing a filler to raise the specific gravity to 3–7. The preferred plastic material was nylon-6 or nylon-6,6 and the filler material was a finely divided metal, preferably a mixture of copper, bronze or tungsten.

U.S. Pat. No. 5,237,930 to Belanger et al., proposes an ammunition comprising a compacted mixture of fine copper powder and a thermoplastic resin selected from the group consisting of nylon-11 and nylon-12. The mixture, which is compacted by injection molding, has at least 90% by weight of copper and a minimum specific gravity of 5.7.

The applicant has utilized other nylons, such as Nylon 6/12 in prior frangible bullet formulations.

Such prior art techniques have, in some cases, reduced lead pollution at ranges. Others have eliminated lead pollution, but have created other problems such as excessive wear and safety hazards from splash back and ricochet. While the solutions of SFM, Booth and Belanger have eliminated lead in the projectile, their resulting projectiles have far less weight and mass than that of the conventional ammunition they are intended to mimic. This factor causes two significant problems. First, the weight of this prior art frangible ammunition is insufficient to cycle properly in the autoloaders used by many shooters. Second, the insufficient weight contributes to a projectile trajectory which is significantly different than conventional ammunition of similar caliber, making the practice ammunition an inadequate substitute for the live round. To compensate for the lack of weight and/or mass, manufacturers have attempted to increase the amount of propellant contained in each round in an effort to propel the projectile at a higher speed thereby producing a trajectory path more closely matching the counterpart live round. However, a consequence of these higher propellant loadings is an increased chamber pressure in the firearm which can in some cases, come dangerously close to the maximum limitation allowable under SAAMI (Sporting Arms and Ammunition Manufacturers' Institute) guidelines, creating potential hazards in weapons that may be worn or stressed and thus, susceptible to rupture and fragmentation from these higher chamber pressures.

In light of the deficiencies noted in the prior art, a new alternative frangible practice ammunition is presented which more closely approximates the firing characteristics of live ammunition than has heretofore been possible.

SUMMARY OF THE INVENTION

In accordance with the present invention, there is provided a lead-free ammunition round which may be freely used at firing ranges and galleries.

It is object of this invention to provide an ammunition bullet or projectile which will substantially disintegrate on impact with a hard surface. This disintegration will eliminate ricochets and splash backs which may be hazardous in firing ranges or similar galleries.

It is another object of this invention to produce a bullet that comes as close as possible in weight, mass and accuracy to that of compatibly sized conventional ammunition.

For purposes of this invention, the following commonly used and accepted definitions apply. The terms "cartridge" and "ammunition" are used interchangeably to refer to a complete unit consisting of the brass, case, primer, propellant powder and bullet. The term "bullet" most often refers to a solid, single projectile used in a rifle or handgun. However, for purposes of this application, the terms "bullet" or "projectile" may also refer to the pellets or solid slugs contained in the load of shotgun cartridge.

The present invention, in its preferred embodiment, is a frangible projectile comprising a polyester matrix containing a high percentage of high density powder dispersed throughout. The preferred high density powder is copper, though compositions of the present invention may utilize one or more of tungsten, bismuth, ceramic, stainless steel or other high density metal powders in addition to or instead of the preferred copper powder. The resulting compounds are capable of injection molding under pressure in multiple cavity molds to produce projectiles in virtually any caliber.

The objects of the present invention are accomplished by a frangible practice bullet comprising: a polyester resin matrix; a powder consisting of one or more materials selected from the group consisting of copper, tungsten, ceramic, bismuth, stainless steel or bronze, the powder present in an amount of at least 85% by weight and dispersed throughout the polyester matrix.

These and other objects of this invention will be evident when viewed in light of the drawings, detailed description, and appended claims.

DETAILED DESCRIPTION OF THE INVENTION

In use, the bullets of the present invention are made of from 85% to 93% by weight of copper, tungsten, ceramic, bismuth, stainless steel or bronze, or blends/alloys of the identified materials, the powder present in a polyester matrix with a small amount of ionomer. The bullets are injection molded under pressure to produce a projectile of appropriate size and weight and comparable to similarly sized live ammunition. The consistency of the bullet is such that it is frangible and will break upon impact with any hard surface, such as sheet steel.

Polyester is a preferred polymeric matrix material in that it is a far more dense polymer than those used in the prior art attempts discussed previously. The specific gravity of polyesters is ~1.30, as compared with ~1.02 for nylons. This enables the fabrication of a bullet with a greatly increased weight, for while the copper/polymer ratio remains at approximately the 90/10 range, the increased density allows for more actual copper by weight.

Polyester is superior to nylon additionally because of its higher crystallinity and higher melt temperatures. In practice, this means that the polyester/copper mix will exhibit a better quality of frangibility than will nylon/copper. This characteristic has however in the past, precluded loading mixtures of metal/polyester to no more than a 65/35 ratio, far less than that which would be desirable for the application of polyester to frangible bullet technology. Metal ratios higher than this have made the resulting product far too frangible, causing it to fragment in the loading process. The addition of small quantities of ionomer resin, e.g., about one (1) percent Surlyn®, manufactured by E.I. dupont de Nemours, to the polyester has the effect of impact-modifying the mixture and reducing the excessive frangibility noted with polyester alone. The addition of ionomer has enabled the achievement of 90/10 copper/polyester ratios of the current invention.

Ionomer resins are copolymers of ethylene and a vinyl monomer with an acid group, such as methacrylic acid. They are crosslinked polymers in which the linkages are ionic as well as covalent bonds. They contain positively and negatively charged groups which are not associated with each other, and this polar character makes these resins unique, particularly due to their carboxylic acid salts present in the resin, the metallic counter ion being for example, sodium or zinc. The ionic interchain forces clustered between the long-chain molecules of the polymer structure give ionomer resins solid state properties normally associated with a crosslinked structure. However, these polymers are processed at conventional temperatures in standard injection molding and extrusion equipment like other thermoplastic resins. Ionomer properties vary with the proportion of carboxylic acid, and the amount and type of metallic ion.

In the specific instance of Surlyn®, the thermoplastic is produced as a granular material which is flexible, transparent, grease-resistant, very light-weight, yet tough. The Izod impact strength is 5.7–14.6 ft-lb/in., which is higher than any other polyolefin. It additionally has a tensile strength of 3,500–5,500 psi, elongation of 300–400%, softening point of approximately 160° F., is insoluble in any commercial solvent, exhibits slow swelling by exposure to hydrocarbons and is only slowly attached by thermoforming.

In a preferred embodiment of this invention, the polyester binder, ionomer and metal powder are mixed in a high intensity ribbon mixer, dried to a relative humidity of less than 0.25% and the resulting mixture extruded into a homogeneous compound. The result is then pelletized before being injection molded into the final form. The compound is molded at a temperature of 550° F. to 570° F. Injection pressures are in excess of 20,000 psi. Using this procedure has resulted in the successful manufacture of a 9mm bullet with a weight of 105 grains, or 23% more weight than the bullets cited as the maximum weight possible in the Belanger patent.

The use of polyester, which exhibits superior repeatability characteristics when compared to nylon, enables closer tolerances in the manufacturing process when compared to nylon, a critical point in ballistics.

Polyesters which have been used by the inventors in the fabrication of bullets have included polyalkylene terephthalates and aromatic homopolyesters. Polyalkylene terephthalate compounds would include those such as polybutylene terephthalate (PBT) and polyethylene terephthalate (PET). Polybutylene terephthalate offers a range of performance characteristics such as good mechanical strength and toughness, broad chemical resistance, lubricity and wear resistance in addition to good surface appearance. PBT has a rapid crystallization rate which, when coupled with its good mold flow, results in very short molding cycles. PBT has a specific gravity of between 1.34 and 1.38, thereby offering good loading capabilities necessary to achieve the density of the present invention.

Polyethylene terephthalate has good strength, toughness, clarity, and resists weal acids, bases, and many other solvents. It also has the advantage of being readily available at low cost, due to the recycling of large quantities of this material from the beverage bottle industry. At a specific gravity of between 1.34 and 1.39, this material offers similar loading capabilities to that of PBT.

Thermoplastic polyesters such as polyethylene terephthalate and polybutylene terephthalate are produced by the polyesterification reaction between a single glycol and a single dibasic acid. Equally envisioned to be within the scope of this invention is a copolyester for which the synthesis thereof would include more than one glycol and/or more than one dibasic acid. The copolyester chain is less regular than the monopolyester chain and therefore has a reduced tendency to crystallize. Specific examples of such copolyesters would include PCTA copolyesters, a polymer of cyclohexanedimethanol and terephthalic with another acid substituted for a portion of the terephthalic acid that would otherwise have been required and PETG copolyesters, a glycol-modified PET.

Aromatic homopolyesters, commercially available under the tradename EKONOL (Carborundum Corp.), is a homopolyester of repeating p-oxybenzoate units. This linear polymer exhibits a high degree of crystallinity and does not melt below its decomposition temperature of 450° C. This makes it particularly applicable for use in bullets that will be normally fired from automatic weapons, where the firing process itself causes high barrel temperatures which tend to degrade bullets made of nylon in particular. This homopolyester can also be blended up to 25% with PTFE, i.e., Teflon® or tetrafluoroethylene, as an organic wear additive, once again making it useful for weapons through which high numbers of rounds will be fired. Specific gravities are similar to those of PBT and PET. Another specific example of an aromatic polyester is polyarylate, a 1:1 ratio of isoterephthalic acid and bisphenol A.

It is also anticipated that thermoset polyesters, such as alkyd polyesters, will also function in the fabrication of bullets made in accordance with the above invention. Thermosets in particular, would appear to have a place in the fabrication of bullets having an outer shell of such material, and filled with other compounds such as bismuth. This material has an even higher specific gravity (i.e., 1.6 to 2.3), in its filled form, than the thermoplastic compounds discussed previously. Alkyd resins are the reaction product of a dihydric or polyhydric alcohol (e.g., ethylene glycol or glycerol) and a polybasic acid (e.g., phthalic anhydride) in the presence of a drying oil (e.g., linseed, soybean) which acts as a modifier. Alkyds are actually a type of polyester resin, which has a similar derivation, but is not oil-modified. Alkyd resins may be produced by direct fusion of glycerol, phthalic anhydride and drying oil at from 410°–450° F. Solvents are then added to adjust the solids content. The amount of drying oil varies depending upon the intended use.

In its most generic form, this invention relates to polyesters, which are made from: ω-hydroxycarboxylic acids forming essentially linear polyesters having repeating units of $—C(O)—(CH_2)_x—O—$; diols with dicarboxylic acids or their derivatives forming essentially linear polyesters having repeating units of $—C(O)—(CH_2)_x—C(O)—(CH_2)_y—O—$; triols or polyols with dicarboxylic acids or polycarboxylic acids and derivatives thereof to form branched and crosslinked polyesters.

The best mode for carrying out the invention will now be described for the purposes of illustrating the best mode known to the applicant at the time. The examples are illustrative only and not meant to limit the invention, as measured by the scope and spirit of the claims.

EXAMPLES

In a preferred embodiment, a polyester-based bullet was fabricated in the following manner. Micro-pulverized copper powder (90% by weight) was mixed with polyethylene terephthalate (9% by weight) and Surlyn® ionomer resin (1% by weight) in a high intensity ribbon mixer. The mixture was dried to a relative humidity of approximately 0.2% and extruded into a homogeneous compound. The mixture was then pelletized. A Van Dorn 150 ton machine, set for 25,000 psi and a molding temperature of 555° F. was used to injection mold the pelletized mixture into a 58-cavity insulated runner mold. The resulting bullets weighted 105 grains, ±0.5 grains.

TABLE 1

| Shooters | Standard | Prior Art #1 | Prior Art #2 | Preferred Embodiment |
|---|---|---|---|---|
| 1 | 3.50 | 6.10 | 6.40 | 3.20 |
| 2 | 2.10 | 6.00 | 6.20 | 2.40 |
| 3 | 2.60 | 4.00 | 5.00 | 2.50 |
| 4 | 3.00 | 3.80 | 4.20 | 2.50 |
| 5 | 1.80 | 4.00 | 3.50 | 1.80 |
| 6 | 3.20 | 4.50 | 4.80 | 3.00 |
| 7 | 2.50 | 4.10 | 3.90 | 2.80 |
| 8 | 2.00 | 3.90 | 4.20 | 2.20 |
| 9 | 3.10 | 4.90 | 5.00 | 3.50 |
| 10 | 2.90 | 3.90 | 3.80 | 1.50 |
| Avg. | 2.57 | 4.52 | 4.70 | 2.54 |

In the above table, the standard results were generated using Winchester 115 grain jacketed hollowpoint. In the table, Prior Art #1 is practice ammunition purchased from SNC Industrial Technologies and believed to be manufactured according to U.S. Pat. No. 5,237,930. Prior Art #2 represents practice ammunition originating from Delta (thought to be a U.S. subsidiary of OTEC Services, Ltd., England) and believed to manufactured utilizing Nylon 6 or 66. The results for Nylon 11 were achieved using 1,450 feet per second (FPS) while the results for Nylon 6 were achieved using 1,400 FPS, the velocity measurements being derived from using an elapsed time meter (chronograph) and skyscreens. The Polyester data was generated at 1,125 FPS and the Standard at an average of between 1,050 and 1,150 FPS.

The lower velocity is an advantage in two areas. First, it is easier to achieve standard improvements in accuracy. The inventors have found that the higher the velocity, the greater the decrease in accuracy for bullets with slight imperfections. And more importantly, is that there is far less barrel wear at the lower velocities. High velocities tend to increase barrel heat, and contribute to blow-by, the effect observed when gases escape around the bullet in the barrel, which wears the barrel excessively. During testing of each composition the lowest velocity which still allowed cycling through autoloaders was used.

The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof.

What is claimed is:

1. A frangible ammunition comprising:

(a) a powder selected from the group consisting of copper, tungsten, bismuth, ceramic, bronze and stainless steel and combinations thereof, wherein the powder is at least 85% by weight of the ammunition;

(b) a polyester resin; and (c) an ionomer resin.

2. The ammunition of claim 1 wherein the polyester resin is at least 7 weight percent.

3. The ammunition of claim 2 wherein the polyester resin is selected from the group consisting of ω-hydroxycarboxylic acids forming essentially linear polyesters having repeating units of $—C(O)—(CH_2)_x—O—$, diols with dicarboxylic acids or their derivatives forming essentially linear polyesters having repeating units of $—C(O)—(CH_2)_x—C(O)—(CH_2)_y—O—$, and triols or polyols with dicarboxylic acids or polycarboxylic acids and derivatives thereof to form branched and crosslinked polyesters.

4. The ammunition of claim 3 wherein the polyester resin is a polyalkylene terephthalate wherein the alkylene group is from 2 to 6 carbons.

5. The ammunition of claim 4 wherein the polyalkylene terephthalate is selected from the group consisting of polyethylene terephthalate and polybutylene terephthalate.

6. The ammunition of claim 3 wherein the polyester resin is an aromatic homopolyester.

7. The ammunition of claim 6 wherein the aromatic homopolyester is comprised of repeating units of p-oxybenzoate units.

8. The ammunition of claim 7 wherein the aromatic homopolyester is blended with up to 25% by weight of polytetrafluoroethylene.

9. The ammunition of claim 3 wherein the polyester resin is an alkyd polyester.

10. The ammunition of claim 9 wherein the alkyd polyester is the reaction product of a dihydric or polyhydric alcohol and polybasic acid in the presence of a drying oil.

11. The ammunition of claim 3 wherein the ionomer resin has an Izod impact strength is 5.7–14.6 ft-lb/in., a tensile strength of 3,500–5,500 psi, elongation of 300–400%, and a softening point of approximately 160° F.

12. The ammunition of claim 11 wherein the ionomer resin is from 0.01 to 8 weight percent.

13. The ammunition of claim 12 wherein the ionomer resin is from 0.1 to 3 weight percent.

14. The ammunition of claim 13 wherein the ionomer resin is from 0.5 to 1.5 weight percent.

* * * * *